US008721261B2

(12) United States Patent
Joubert et al.

(10) Patent No.: US 8,721,261 B2
(45) Date of Patent: May 13, 2014

(54) COMPRESSOR COVER FOR TURBINE ENGINE HAVING AXIAL ABUTMENT

(75) Inventors: Philippe Denis Joubert, Angais (FR); Patrice Laborde, Billere (FR); Yann Mouze, Limendous (FR); Philippe Perot, Lons (FR)

(73) Assignee: Turbomeca, Bordes (FR)

( * ) Notice: Subject to any disclaimer, the term of this patent is extended or adjusted under 35 U.S.C. 154(b) by 425 days.

(21) Appl. No.: 12/994,830

(22) PCT Filed: May 20, 2009

(86) PCT No.: PCT/FR2009/050939
§ 371 (c)(1),
(2), (4) Date: Nov. 26, 2010

(87) PCT Pub. No.: WO2009/153478
PCT Pub. Date: Dec. 23, 2009

(65) Prior Publication Data

US 2011/0076141 A1 Mar. 31, 2011

(30) Foreign Application Priority Data

May 26, 2008 (FR) ..... 08 53394

(51) Int. Cl.
*F01D 11/08* (2006.01)

(52) U.S. Cl.
USPC ..... 415/9; 415/173.1; 415/206

(58) Field of Classification Search
USPC ..... 415/9, 134, 149.1, 152.2, 156, 158, 415/173.1, 203–206, 224.5
See application file for complete search history.

(56) References Cited

U.S. PATENT DOCUMENTS

| | | | | |
|---|---|---|---|---|
| 2,656,096 | A * | 10/1953 | Schwarz | 417/323 |
| 3,613,360 | A | 10/1971 | Howes | |
| 4,264,271 | A | 4/1981 | Libertini | |
| 4,687,412 | A | 8/1987 | Chamberlain | |
| 5,427,498 | A | 6/1995 | Lehe et al. | |
| 6,224,321 | B1 * | 5/2001 | Ebden et al. | 415/9 |
| 2008/0069690 | A1 | 3/2008 | Ivakitch et al. | |

FOREIGN PATENT DOCUMENTS

| | | |
|---|---|---|
| EP | 1 903 185 | 3/2008 |
| FR | 2 698 666 | 6/1994 |
| JP | 47-50685 B | 12/1972 |
| JP | 2002531760 | 9/2002 |
| JP | 2003120591 | 4/2003 |
| RU | 2352826 | 4/2009 |
| WO | 00 34628 | 6/2000 |

OTHER PUBLICATIONS

International Search Report Issued Apr. 14, 2010 in PCT/FR09/050939 filed May 20, 2009.

(Continued)

*Primary Examiner* — Edward Look
*Assistant Examiner* — Aaron R Eastman
(74) *Attorney, Agent, or Firm* — Oblon, Spivak, McClelland, Maier & Neustadt, L.L.P.

(57) ABSTRACT

A centrifugal compressor for a turbine engine, including a cover with an upstream end and a downstream end; a casing presenting an upstream edge and a downstream edge; and a bladed impeller mounted to rotate in the casing. The cover covers the blades of the impeller to define an outside surface of a gas-flow passage extending between the upstream and downstream edges of the casing, while being fastened to the upstream edge of the casing via its upstream end while its downstream end remains free. The cover further includes an abutment limiting axial movement of its downstream end relative to the downstream edge of the casing while the compressor is in operation.

8 Claims, 2 Drawing Sheets

(56) References Cited

OTHER PUBLICATIONS

English translation of Office Action issued May 15, 2013, in Russian Application No. 201053329/6(077104), filed May 20, 2009.

Office Action issued on Aug. 20, 2013 in Japanese Patent Application No. 2011-511060 (2 pages), with English translation (3 pages).

Decision to Grant issued on Oct. 15, 2013 in Russian Patent Application No. 2010153329/06(077104), filed on May 20, 2009. English translation only (3 pages).

* cited by examiner

COMPRESSOR COVER FOR TURBINE ENGINE HAVING AXIAL ABUTMENT

BACKGROUND

The present invention relates to the field of gas turbines, in particular those to be found in turbomachines, and by way of non-limiting examples but not only in the turbine engines of helicopters or in the turbojets for airplanes.

The present invention relates more particularly to the compression stage of such gas turbines that constitute the main power plant of an aircraft.

Still more precisely, the present invention relates to a centrifugal compressor of a turbine engine, the compressor comprising:

a cover including an upstream end and a downstream end;

a casing presenting an upstream edge and a downstream edge; and a bladed impeller mounted to rotate in said casing;

said cover being designed to cover the blades of the impeller so as to define an outside surface of a gas-flow passage extending between the upstream and downstream edges of the casing, being fastened to the upstream edge of the casing via its upstream end while its downstream end remains free.

Conventionally, the compressor is placed between a fresh air inlet and a combustion chamber, the role of the compressor being to compress the fresh air entering into the gas turbine and to convey the compressed air into the combustion chamber in order to be mixed with fuel.

Furthermore, it is known that an impeller comprises a plurality of blades extending generally radially from an impeller hub, which hub is fastened to a rotary shaft of the gas turbine.

Thus, the gas stream initially enters into the casing of the compressor via an upstream inlet, and then flows along a gas-flow passage defined between an outside surface defined by the cover and an inside surface defined by a surface of the impeller hub, while being compressed and driven in rotation about the axis of the impeller prior to being exhausted through a downstream outlet of the compressor, it being specified that the terms "upstream" and "downstream" are taken relative to the flow direction of the gas in the gas-flow passage through the compressor.

Generally, the stream of compressed gas leaving the impeller then penetrates into a diffuser prior to entering into the combustion chamber.

It can thus be understood that the cover defines the outside surface of the gas-flow passage, with the inside surface of the passage being formed by a surface of the impeller hub from which the blades extend.

In order to control the thermomechanical behavior of the cover, its downstream end is generally left free, i.e. it is not fastened to the downstream edge of the casing.

This configuration serves to avoid the cover being secured in a statitically overdetermined manner which would have the potential of damaging control over the clearances between the impeller and the cover.

Nevertheless, that solution is not perfect: certain degraded behaviors of the compressor, such as pumping or other unstable phenomena, for example, can appear and can lead to sudden variations of pressure within the impeller of the compressor.

Insofar as the downstream end of the cover is free, it will be understood that it can deform slightly as a result of pressure variations inside the compressor, and that such deformation might lead to the cover coming into contact with the blades of the impeller. When the pressure inside the compressor drops below that existing outside the cover, then the cover tends to deform so as to come into contact with the blades of the impeller. This deformation may also be due to vibration.

Naturally, it is extremely harmful both for the cover and for the impeller if the cover comes into contact with the blades of the impeller, where such contact might seriously damage the compressor.

Such a phenomenon may also occur when the gas turbine is being operated under extreme conditions.

One solution to the problem is to increase the clearance that exists between the cover and the blades of the impeller. Nevertheless, such a solution presents the drawback of reducing the efficiency of the compressor, and consequently of diminishing the performance of the gas turbine.

BRIEF SUMMARY

An object of the invention is therefore to propose a cover that makes it possible to avoid contact with the blades of the impeller during degraded operation of the compressor.

The invention achieves its object by the fact that the cover further includes an abutment for limiting the axial movement of its downstream end relative to the downstream edge of the casing while the compressor is in operation.

Preferably, the abutment is placed at the downstream end of the cover.

By means of the abutment in accordance with the invention, axial movement of the downstream end of the cover is limited.

The downstream end of the cover and the downstream edge of the casing are arranged in such a manner that when the downstream end of the cover comes into abutment against the downstream edge of the casing, clearance still remains between the blades of the impeller and the cover, whereby contact is advantageously avoided.

Preferably, the cover is mounted so as to leave a calibrated amount of axial clearance between the downstream end of the cover and the downstream edge of the casing.

Advantageously, the preferably annular abutment forms a radial extension that extends from the downstream end of the cover. This extension thus extends orthogonally relative to the axis of the impeller when the cover is in place. In a variant, the abutment is constituted by a plurality of radial tongues.

The abutment thus radially covers a circumferential portion of the edge of the casing.

Preferably, the downstream end of the cover also includes an axial extension forming an annular rim suitable for lying almost flush with the downstream edge of the casing when the cover is in place.

An advantage of this axial extension is to provide better guidance for the flow of air downstream from the impeller.

A calibrated small amount of radial clearance is thus provided between the downstream end of the cover and an inside end of the downstream edge of the casing so as to limit sudden changes of shape in the air passage, where such changes are harmful to the efficiency of the compressor.

Finally, the invention also provides a gas turbine, in particular for a helicopter, that includes one or more compressors in accordance with the present invention.

BRIEF DESCRIPTION OF THE DRAWINGS

The invention will be better understood and its advantages appear more clearly on reading the following description of an embodiment given by way of non-limiting example. The description refers to the accompanying drawings, in which.

DETAILED DESCRIPTION

Figure 1A:
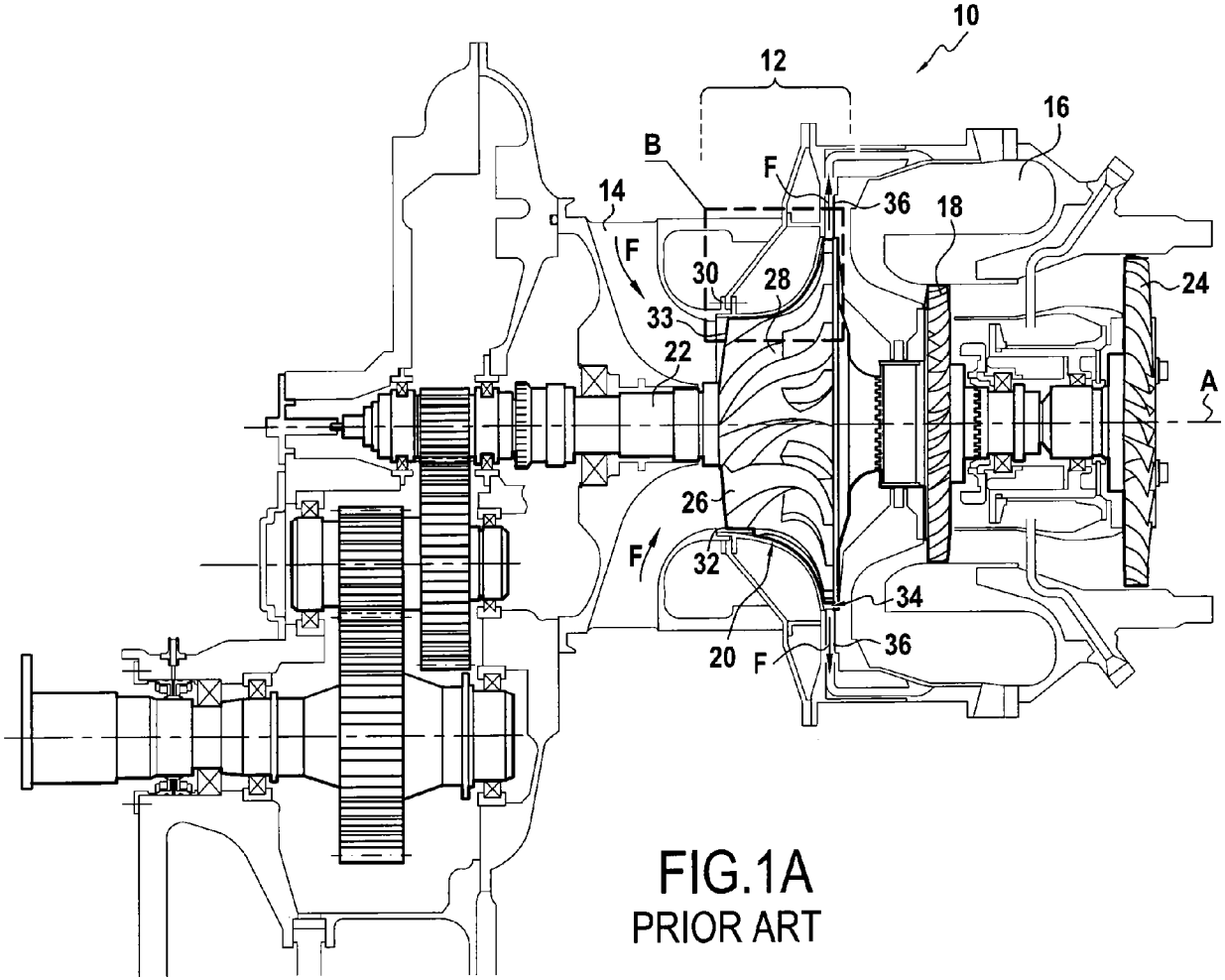
FIG.1A PRIOR ART
FIG. 1A is a section view of a helicopter turbine engine including a compressor provided with a prior art cover.

FIG. 1A is an overall section view of a helicopter turbine engine 10 that is well known.

In this example, the turbine engine 10 is constituted by a gas turbine that comprises a compressor 12, also referred to as a compression stage, an air inlet 14 for admitting fresh air into the compressor 12, and a combustion chamber 16 in which combustion takes place of a mixture of a fuel and the air compressed by the compressor 12.

The turbine engine 10 also includes a turbine 18 connected to a bladed impeller 20 of the compressor 12 via a shaft 22, which turbine 18 is set into motion by the stream of burnt gas leaving the combustion chamber 16 and serves to drive the impeller 20 in rotation.

Finally, the turbine engine 10 also includes a free turbine 24 that is driven in rotation by the stream of gas leaving the turbine 18, said free turbine serving to drive the rotors of the helicopter (not shown) in rotation.

The bladed impeller 20, of the centrifugal impeller type, is well known from elsewhere. It comprises a hub 26 from which there extend radially a plurality of blades 28 that may present shapes that are curved, with the radial ends thereof being contained in a geometrical envelope that has the shape of a hyperboloid of revolution. The impeller 20 also presents an axis of rotation A and the term "axial" is used relative to said axis.

Furthermore, the compressor 12 includes a casing 30 that preferably forms a component part of the casing of the turbine engine 10.

The casing 30 is the structure that holds together the elements of the compressor; in this respect, the impeller 20 is mounted to rotate in the casing 30.

The casing 30 presents an upstream edge 32 and a downstream edge 34, it being specified that the terms "upstream" and "downstream" are considered relative to the flow direction of the gas stream inside the compressor 20. The flow direction is represented by arrows F in the various figures.

Figure 1B:
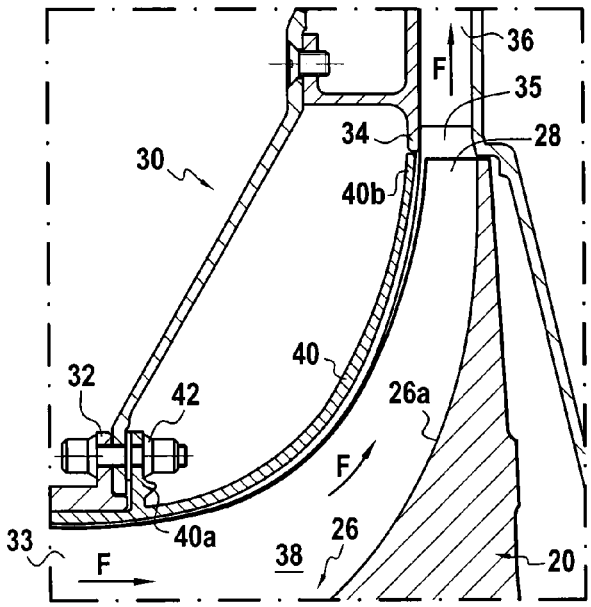
FIG.1B PRIOR ART
FIG. 1B is a detail view of the FIG. 1A cover.

From FIG. 1B, it can be understood that the gas stream F enters into the bladed impeller 20 axially via an upstream inlet 33 and leaves it radially via an outlet 35 close to the downstream edge 34 of the casing 30 prior to penetrating into a diffuser 36. The downstream edge 34 of the casing 30 is constituted by an upstream edge of the diffuser 36 in this example.

It can be understood that the gas stream flows between the blades 28 of the impeller 20 in a gas-flow passage 38 extending from the upstream edge 32 to the downstream edge 34 of the casing 30.

It can also be seen that the passage 38 is defined between a surface 26*a* constituted by the hub 26, from which hub the blades 28 extend, and a cover 40 defining an outside surface of the passage 38.

In other words, the cover 40 covers the blades 28 of the impeller 20 so that it extends between the upstream edge 32 of the casing and the downstream edge 34 of the casing 30 while fitting substantially to the shape of the above-mentioned geometrical envelope. In other words, the clearance between each of the blades 28 and the cover 40 is small.

More precisely, the cover 40 has an upstream end 40*a* and a downstream end 40*b*, the upstream end 40*a* being fastened to the upstream edge 32 of the casing via a fastener member 42, while the downstream end 40*b* is free.

In other words, the downstream end 40*b* of the cover 40 is not fastened to the downstream edge 34 of the casing 30.

In contrast, it can be seen that the downstream edge 34 of the casing 30 extends the downstream edge 40*b* of the cover 40 with continuity.

Insofar as the cover 40 is fastened to the casing solely by the upstream edge 32, it can be understood that it is free to deform, essentially at its downstream edge 40*b* that is free.

Figure 2:
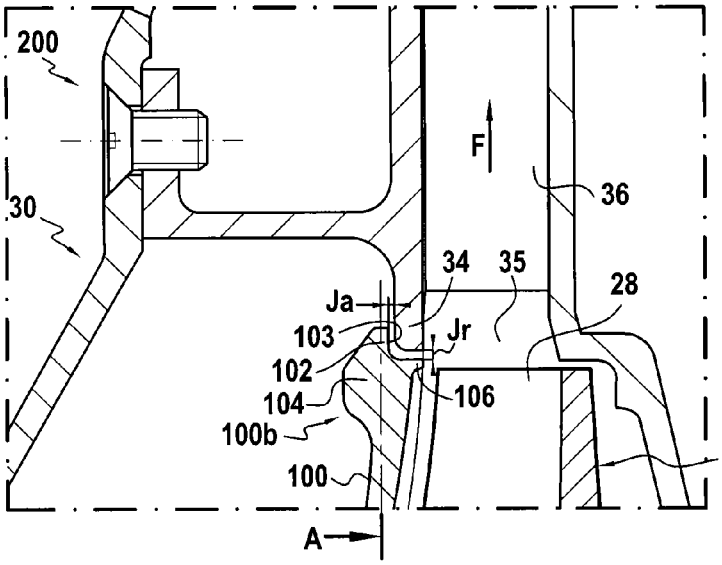
FIG. 2 shows the downstream end of a cover in accordance with the present invention.

With reference to FIG. 2, which shows a detail of a turbine engine of the invention, there follows a description of a cover 100 of a centrifugal compressor 200 in accordance with the present invention, the other component parts of the turbine engine 10 being identical to those described above and carrying the same reference numbers.

As can be seen in FIG. 2, compared with the prior art, the downstream end 100*b* of the cover 100 of the invention further includes an abutment 102 forming a radial extension that extends orthogonally relative to the axis A of the impeller 20.

Figure 3:
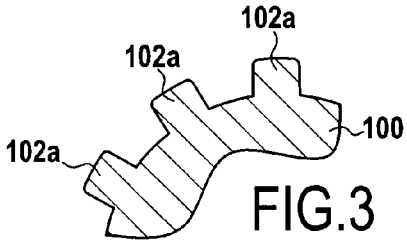
FIG. 3 shows a variant of the cover.

This abutment 102, which is preferably annular, serves to limit the axial movement of the downstream end 100*b* of the cover 100. In a variant shown in FIG. 3, the abutment is constituted by a plurality of radial tongues 102*a*.

For this purpose, the abutment 102 has a contact face 103 suitable for bearing against the downstream edge 34 of the casing 30 if the downstream end 100*b* of the cover 100 flexes towards the blades 28 of the impeller, thereby preventing the cover 100 from deforming any further, and thus advantageously avoiding any contact between the cover 100 and the blades 28 of the impeller 20.

In normal operation, axial clearance Ja is ensured between the contact face 103 and the downstream edge 34 of the casing 30.

As can be seen in FIG. 2, the downstream end 100*b* of the cover 100 also includes an axial swelling 104 that extends in the opposite direction to the contact face 103. This axial swelling presents an annular shape and serves to reinforce the mechanical strength of the abutment 102, which is subjected to mechanical stress when it comes into contact with the downstream edge 34 of the casing 30.

Furthermore, the downstream end 100*b* also includes an axial extension 106 in the form of an annular rim that is designed to come substantially flush with the downstream edge 34 of the casing 30. More precisely, small radial clearance Jr is provided between this annular rim 106 and the downstream edge 34 so as to prevent the stream of gas being disturbed in the gap that exists between the downstream end 100*b* of the cover 100 and the downstream edge 34 of the casing 30.

Preferably, the annular rim 106 is arranged in such a manner as to present a radial height that is greater than the height of the trailing edges of the blades.

Preferably, the inside surface of the cover 100, beside the impeller, is covered in an abradable material, known from elsewhere, in order to avoid damaging the cover and the blades in the event of them coming into contact.

The invention claimed is:

1. A centrifugal compressor of a turbine engine, the compressor comprising:

a cover including an upstream end and a downstream end;

a casing presenting an upstream edge and a downstream edge; and a bladed impeller mounted to rotate in the casing;

the cover configured to cover the blades of the impeller so as to define an outside surface of a gas-flow passage extending between the upstream and downstream edges of the casing, being fastened to the upstream edge of the casing via the upstream end while the downstream end remains free, wherein the cover further includes an abutment separated from the downstream edge of the casing in an axial direction to limit axial movement of the downstream end of the cover relative to the downstream edge of the casing while the compressor is in operation, and wherein the downstream end of the cover further includes an axial extension forming an annular rim.

2. A centrifugal compressor according to claim 1, wherein the abutment forms a radial extension extending from the downstream end of the cover.

3. A centrifugal compressor according to claim 1, wherein the abutment is annular.

4. A centrifugal compressor according to claim 1, wherein the abutment includes a plurality of radial tongues.

5. A gas turbine including a centrifugal compressor according to claim 1.

6. A centrifugal compressor according to claim 1, wherein the annular rim has a radial height that is greater than a radial height of trailing edges of the blades of the impeller.

7. A centrifugal compressor of a turbine engine, the compressor comprising:

a cover including an upstream end and a downstream end;

a casing presenting an upstream edge and a downstream edge; and a bladed impeller mounted to rotate in the casing;

the cover configured to cover the blades of the impeller so as to define an outside surface of a gas-flow passage extending between the upstream and downstream edges of the casing, being fastened to the upstream edge of the casing via the upstream end while the downstream end remains free, wherein the cover further includes an abutment for limiting axial movement of the downstream end of the cover relative to the downstream edge of the casing while the compressor is in operation, and wherein the downstream end of the cover further includes an axial extension forming an annular rim.

8. A centrifugal compressor according to claim 7, wherein the annular rim has a radial height that is greater than a radial height of trailing edges of the blades of the impeller.

* * * * *